US009173028B2

(12) United States Patent
Marquis et al.

(10) Patent No.: US 9,173,028 B2
(45) Date of Patent: Oct. 27, 2015

(54) SPEECH ENHANCEMENT SYSTEM AND METHOD

(75) Inventors: Francois Marquis, Corminboeuf (CH); Hans-Ueli Röck, Hombrechtikon (CH); Samuel Harsch, Ballaigues (CH); Yacine Azmi, San Jose, CA (US); Tim Jost, Auvernier (CH)

(73) Assignee: Sonova AG, Staefa (CH)

( * ) Notice: Subject to any disclaimer, the term of this patent is extended or adjusted under 35 U.S.C. 154(b) by 116 days.

(21) Appl. No.: 14/232,693

(22) PCT Filed: Jul. 14, 2011

(86) PCT No.: PCT/EP2011/062051

§ 371 (c)(1),
(2), (4) Date: Feb. 26, 2014

(87) PCT Pub. No.: WO2013/007309

PCT Pub. Date: Jan. 17, 2013

(65) Prior Publication Data

US 2014/0161272 A1 Jun. 12, 2014

(51) Int. Cl.
*H04R 3/02* (2006.01)
*G10L 21/0208* (2013.01)

(52) U.S. Cl.
CPC ..... *H04R 3/02* (2013.01); *G10L 21/0208* (2013.01)

(58) Field of Classification Search
None
See application file for complete search history.

(56) References Cited

U.S. PATENT DOCUMENTS

| | | | |
|---|---|---|---|
| 3,894,195 | A | 7/1975 | Kryter |
| 4,025,721 | A | 5/1977 | Graupe et al. |
| 4,237,339 | A | 12/1980 | Bunting et al. |
| 5,394,475 | A | 2/1995 | Ribic |
| 7,068,798 | B2 | 6/2006 | Hugas et al. |
| 8,311,234 | B2 | 11/2012 | Sakuraba |
| 2012/0221329 | A1 | 8/2012 | Harsch |

FOREIGN PATENT DOCUMENTS

| | | | |
|---|---|---|---|
| DE | 25 26 034 | A1 | 1/1976 |
| EP | 0 581 261 | A1 | 2/1994 |
| EP | 1 429 315 | A1 | 6/2004 |
| JP | 2008-141734 | A | 6/2008 |
| WO | 03/010996 | A2 | 2/2003 |
| WO | 2010/000878 | A2 | 1/2010 |
| WO | 2011/027005 | A2 | 3/2011 |

*Primary Examiner* — Paul Huber
(74) *Attorney, Agent, or Firm* — Roberts Mlotkowski Safran & Cole, PC

(57) ABSTRACT

A system for speech enhancement in a room having a directional lapel microphone arrangement for capturing an audio signal from a speaker's voice; audio signal processor for generating a processed audio signal from the captured audio signal, and an adaptive beamformer unit for imparting directivity to the microphone arrangement provides maximum sensitivity towards the speaker's mouth and minimum sensitivity towards noise sources identified by the beamformer unit. A unit shifts the frequency of components of the audio signal above a frequency threshold value only. A feedback cancelling unit has an adaptive filter and a selection unit which automatically switches between a first mode causing the audio signal to by-pass the adaptive filter and a second mode in which the audio signal is filtered by the adaptive filter. A loudspeaker arrangement generates sound according to the processed audio signal and has plural loudspeakers arranged to form a directional loudspeaker array.

22 Claims, 4 Drawing Sheets

SPEECH ENHANCEMENT SYSTEM AND METHOD

BACKGROUND OF THE INVENTION

1. Field of the Invention

The invention relates to a system for speech enhancement in a room comprising a microphone arrangement for capturing audio signals from a speaker's voice, means for processing the captured audio signals and a loudspeaker arrangement located in the room for generating amplified sound according to the processed audio signals.

2. Description of Related Art

By a system of the above-mentioned type, a speaker's voice can be amplified in order to increase speech intelligibility for persons present in the room, such as the listeners of an audience or pupils/students in a class room. Such speech enhancement systems often encounter feedback problems, especially when used with lapel microphones (when the speaker is moving around in the room, feedback conditions are always changing, the minimum stable gain must be selected leading to poor intelligibility; on the other, hand feedback cancellers reduce the intelligibility when in feedback condition). Feedback problems are less severe when boom microphones (which need less gain since they are located very close to the speaker's mouth) are used; however, most speakers prefer to use lapel microphones rather than boom microphones.

An example of a speech enhancement system is described in International Patent Application Publication WO 2010/000878 A2 and corresponding U.S. Patent Application Publication 2012/221329, wherein the audio signal processing includes a feedback canceller which analyzes the captured audio signals in order to determine whether there is a critical feedback level caused by feedback of sound from the loudspeaker arrangement to the microphone arrangement (Larsen effect). The feedback canceller outputs a status signal indicating the presence or absence of feedback conditions to a main control unit in order to reduce the system gain when feedback conditions occur.

German Patent Application DE 25 26 034 A1 and corresponding U.S. Pat. No. 3,894,195 relate to a hearing aid wherein the microphone signals, after having passed an automatic gain control (AGC) stage, undergo frequency shifting by 10 Hz in order to reduce feedback, so that the maximum gain can be increased by about 10 dB.

U.S. Pat. No. 5,394,475 relates to audio systems providing for a frequency shift of the audio signals in order to reduce feedback, wherein it is mentioned that the frequency shift may be about 5 Hz.

U.S. Pat. No. 4,237,339 relates to the use of directional microphones for feedback reduction in an audio teleconferencing system, wherein the loudspeaker and the microphones are rigidly mounted on a boom and the microphones are located and oriented relative to the loudspeaker in such a manner that the null position of the directivity is directed towards the loudspeaker.

European Patent Application EP 0 581 261 A1 relates to the use of a Wiener filter for feedback reduction in a hearing aid, wherein the Wiener filter is implemented as part of a filter controlled by a user operated control. JP 2008-141734 A and corresponding U.S. Pat. No. 8,311,234 relate to the use of a Wiener filter for feedback reduction in a hands-free telephone system or a video conference system. EP 1 429 315 A1 and corresponding U.S. Pat. No. 7,068,798 relate to the use of a Wiener filter for feedback reduction in a vehicle communication system.

SUMMARY OF THE INVENTION

It is an object of the invention to provide for a speech enhancement system and method having so little sensitivity to feedback that it can be used with a lapel microphone.

According to the invention, this object is achieved by a system and a method as described herein.

The invention is beneficial in that, by providing a directional lapel microphone arrangement (which may be a physical directional microphone or an arrangement with at least two spaced-apart microphones) and an adaptive beamformer for imparting a directivity to the microphone arrangement with maximum sensitivity towards the speaker's mouth and minimum sensitivity towards noise sources, providing the loudspeaker arrangement as a directional loudspeaker array, shifting the frequency of a part of the components of the captured audio signal and by providing an adaptive filter (such as a Wiener filter) which is automatically switched on and off according to the presence or absence of critical feedback, the feedback behavior of the system can be significantly improved, thereby allowing the use of a lapel microphone arrangement at a decent gain in order to improve speech intelligibility in a room, such as a classroom. By shifting only the higher part of the spectrum of the audio signals (typically above 850 Hz), the presence of audible artifacts resulting from the frequency shift can be minimized; for example, the frequency shift may be an upward shift of about 5 Hz. By providing for an automatic switching in the feedback canceller, i.e., by filtering the audio signals by the adaptive filter only when critical feedback conditions have been determined, artifacts and reduced intelligibility resulting from filtering by the adaptive filter can be minimized.

Hereinafter, examples of the invention will be illustrated by reference to the attached drawings.

DETAILED DESCRIPTION OF THE INVENTION

Figure 1:
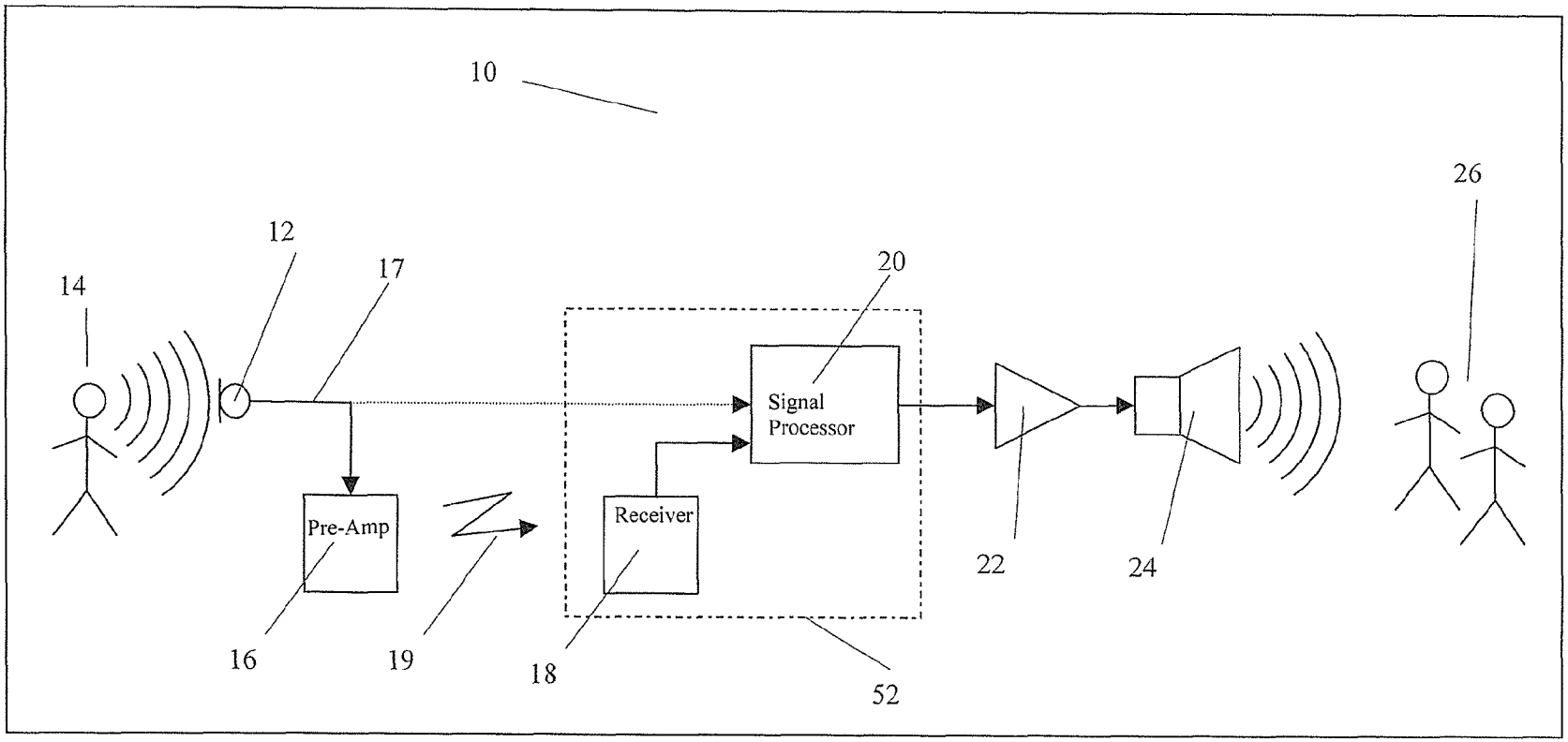
FIG. 1 is a schematic block diagram of a speech enhancement system according to the invention.

FIG. 1 is a schematic representation of a system for enhancement of speech in a room 10. The system comprises a directional lapel microphone 12, which may a physical directional microphone or an arrangement comprising at least two spaced apart acoustic sensors, for capturing audio signals from the voice of a speaker 14, which signals are supplied to a unit 16 which may provide for pre-amplification of the audio signals and which, in case of a wireless microphone, includes a transmitter for establishing a wireless audio link 19, such as an analog FM link or, preferably, a digital link (such as radio or infrared link), and audio signal processing components, such as an acoustic beamformer unit. The audio signals are supplied, either by cable or in case of a wireless microphone, via an audio signal receiver 18, to an audio signal processing unit 20 for processing the audio signals, in particular to apply spectral filtering and gain control to the audio signals. The processed audio signals are supplied to a power amplifier 22 operating at constant gain in order to supply amplified audio signals to a loudspeaker arrangement 24 in order to generate amplified sound according to the processed audio signals, which sound is perceived by listeners 26.

Figure 2:
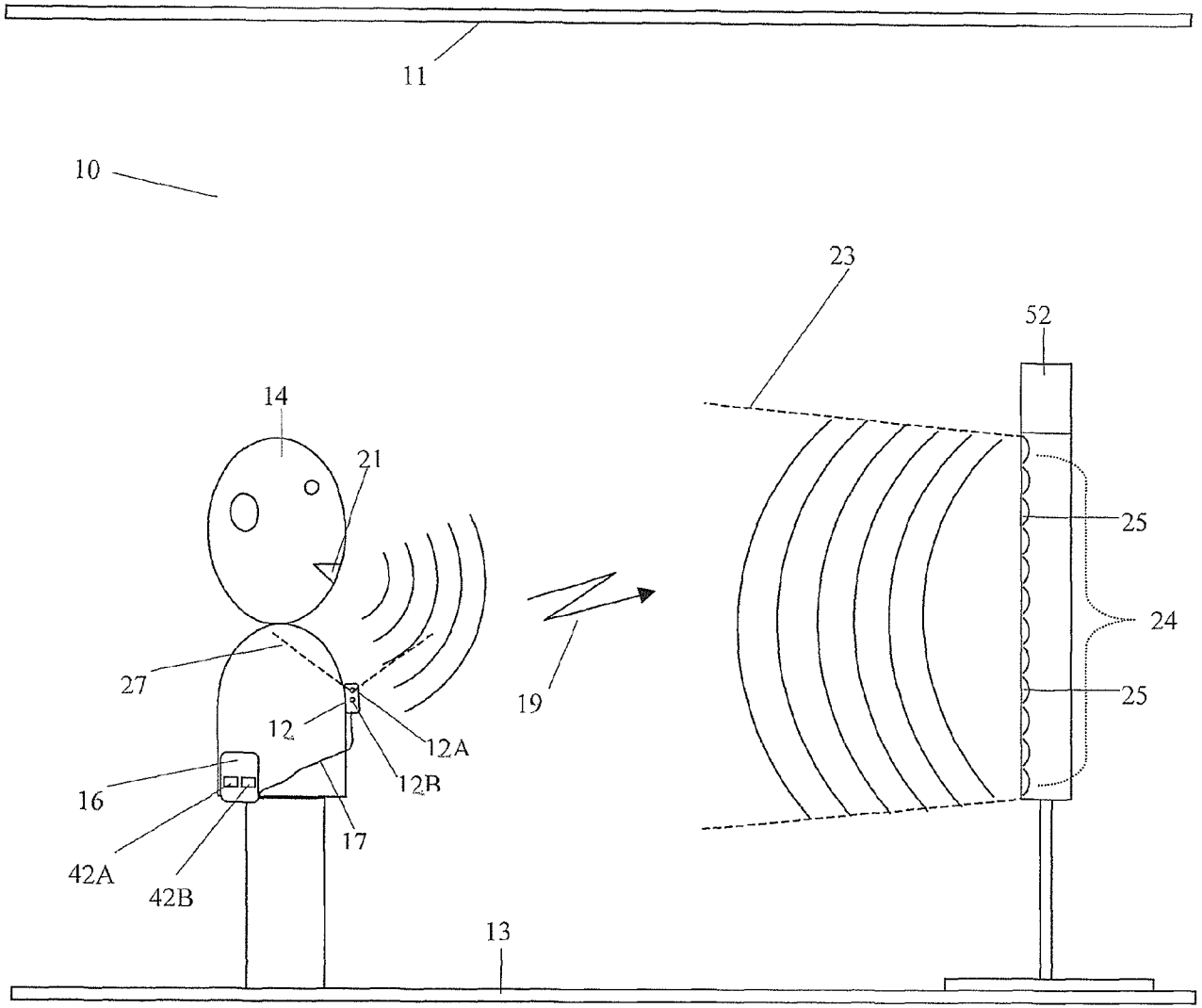
FIG. 2 is a schematic representation of an example of a speech enhancement system according to the invention.

An example of a speech enhancement system according to the invention is schematically shown in FIG. 2, wherein the system is designed as a wireless system, i.e., comprising a wireless audio link 19, preferably a digital link operating, for example, in the 2.4 GHz ISM band. The system includes a transmission unit 16 which is worn at the body of the speaker 14, with a lapel microphone arrangement 12 comprising two vertically spaced-apart microphones 12A and 12B being worn at the speakers' chest and being connected to the transmission unit 16 via a cable 17. The system further includes a receiver unit 52 which is connected to a loudspeaker array 24 that is formed of a plurality of loudspeakers 25 which are arranged vertically stacked one above another. For example, the loudspeaker arrangement 24 may be composed of 12 vertically stacked loudspeakers 25.

Preferably, the directivity of the loudspeaker array 24 is such that the direction of the maximum sound amplitude/pressure is oriented substantially horizontal, so that room reverberation can be minimized by minimizing reflections on the ceiling 11 and the floor 13 of the room 10. Reduced reverberation results in reduced feedback problems. In addition, such horizontal directivity of the loudspeaker array 24 is efficient in that the acoustic coupling with the directivity of the microphone arrangement 12, which has its maximum sensitivity towards the mouth 21 of the speaker 14, i.e., towards the ceiling 11 when worn at the speaker's chest, is minimized (the aperture angle of the directional lapel microphone arrangement 12 as achieved by acoustic beam forming is indicated at 27 in FIG. 2). For example, the vertical aperture angle 23 of the sound field generated by the loudspeaker array 24 may be +/−7 degrees at 2 kHz and +/−25 degrees at 500 Hz, while the horizontal aperture angle is in the range of +/−90 degrees.

Figure 3:
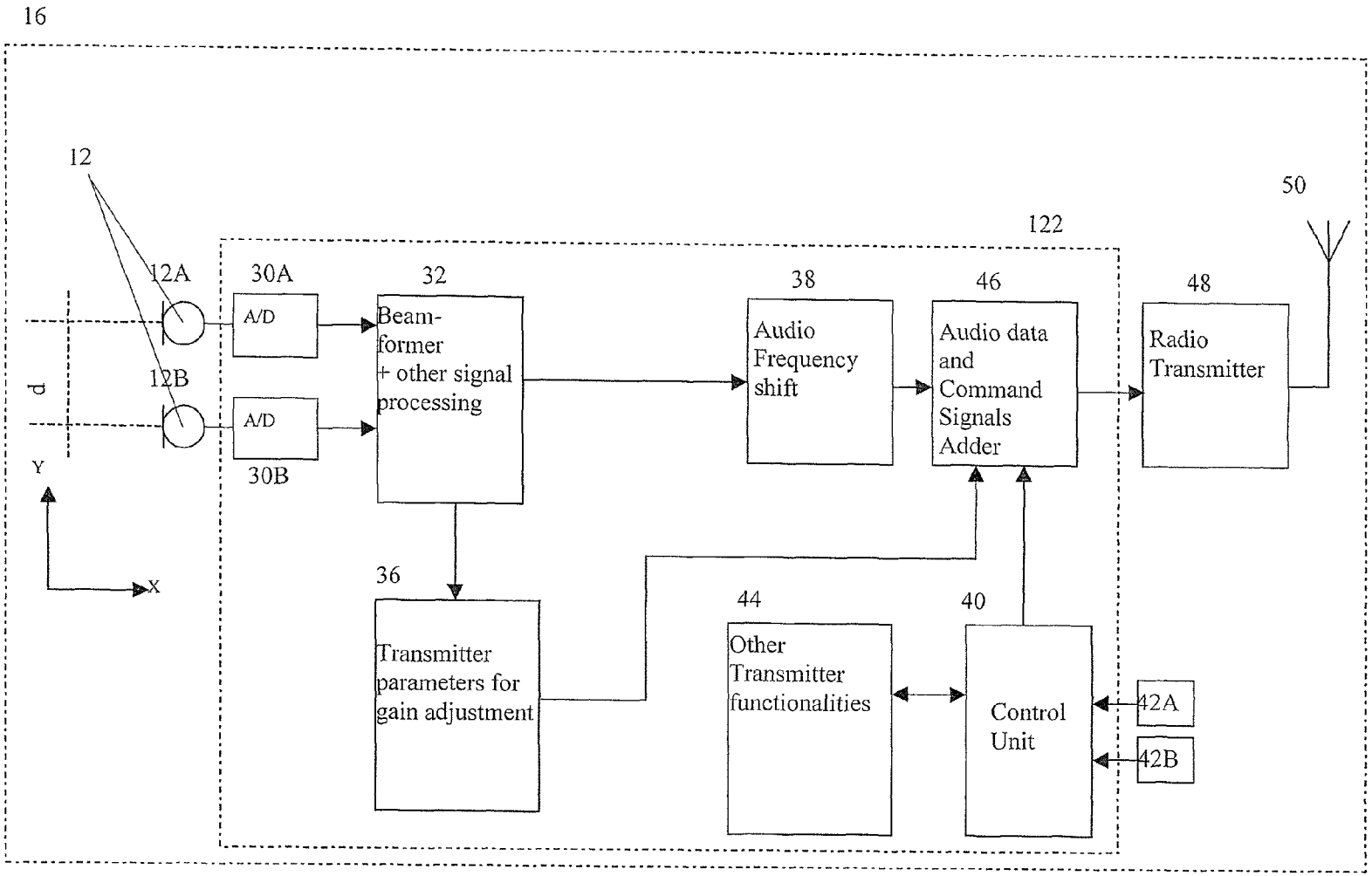
FIG. 3 is a block diagram of a transmission unit of a speech enhancement system according to the invention.
Figure 4:
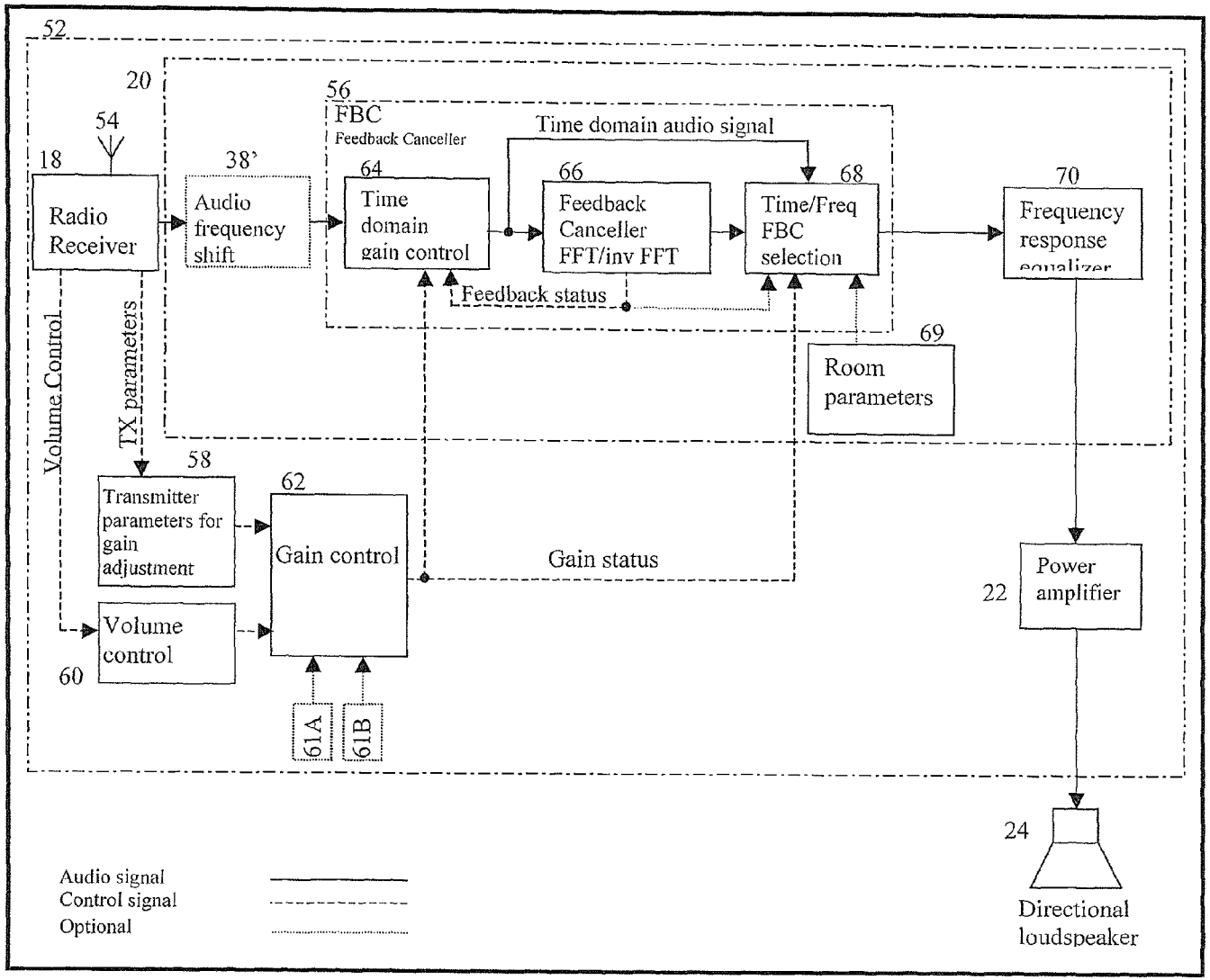
FIG. 4 is a block diagram of a receiver unit of the speech enhancement system of FIG. 3.

A block diagram of an example of a speech enhancement system according to the invention, like the one shown at FIG. 2, is shown in FIGS. 3 and 4.

The directional lapel microphone assembly 12 preferably is formed by two omnidirectional microphones 12A, 12B which are spaced-apart by a distance d (when the microphone arrangement 12 is worn at the user's chest, the microphones 12A, 12B are spaced-apart essentially in the vertical direction). The audio signal captured by the microphones 12A, 12B is converted to digital signals by an analog-to-digital converter 30A, 30B, respectively, with the digital signals being supplied to a signal processing unit 32 which includes a beamformer that imparts a directivity to the microphone arrangement 12 in such a manner that the maximum sensitivity is towards the speaker's mouth 21, i.e., towards the ceiling 11, and the minimum sensitivity is towards noise sources as identified by the beamformer unit 32.

To this end, the signal processing unit 32 continuously searches for noise sources in the captured audio signals, with the beamforming signal processing being adapted to the directions of such noise sources. Preferably, the signal processing unit 32 processes different frequency bands of the audio signals individually in order to enable different directivity patterns in different frequency bands (i.e., the audio signals are split into a plurality of frequency bands prior to being processed); thereby different noise sources creating noise from different directions can be attenuated simultaneously, provided that their main noise amplitude is not in the same frequency band. Since also sound from the loudspeaker array 24 would be classified as "noise" by the signal processing unit 32, such directivity patterns will result in improved feedback behavior of the system, with the "feedback noise" being attenuated.

The signal processing unit 32 also includes a gain model providing for an AGC in order to avoid an over modulation of the transmitted audio signals. A first output from the signal processing unit 32 is supplied to a analyzer unit 36 which analyses the audio signals in order to provide for transmitter parameters which are related to specific variable gain functionalities (for example, the unit 36 may estimate the surrounding noise level and provide for an output signal indicative of the surrounding noise level).

A second output of the signal processing unit 32 is supplied to a frequency shifting unit 38 which shifts the frequency of components of the audio signals which are above a certain frequency threshold value, whereas the components below such threshold value remain unshifted. Preferably, the threshold value is selected from a range from 500 Hz to 2 kHz. For example, the threshold value may be 850 Hz. preferably; the frequency of the audio signal components above the threshold value may be shifted uniformly, for example upwards by about 5 Hz, which shift is particularly suitable for typical classroom sizes.

By shifting only higher audio frequencies, i.e., the frequencies above the threshold value, audible artifacts present in the case of feedback conditions can be significantly reduced. This would not be the case if the frequency shift was applied on the whole audio frequency range (for example, a 5 Hz shift at 100 Hz would be clearly audible). An improvement of up to 6 dB can be achieved in reverberant rooms due to such frequency shift.

The transmission unit 16 also includes a control unit 40 and a user interface 42A, 42B acting on the control unit 40, for example in the form of volume-up and volume-down buttons. The transmission unit 16 also may include other functionalities, such as a LCD control, etc., indicated at 44 in FIG. 3. The audio signal leaving the frequency shifting unit 38 and the output of the control unit 40 are supplied to a unit 46 which combines the audio data from the unit 38 and command signal data from the unit 36 and supplies the combined signal to a radio transmitter 48 which transmits the signal via an antenna 50 via the wireless link 19 to a radio receiver 18 of the receiver unit 52, with an antenna 54 being connected to the receiver 18.

The audio signal part of the data received by the receiver 18 is supplied to a feedback canceller unit 56, whereas transmitter parameters of the received data are supplied to a unit 58, which determines the additional gain to be applied to the received audio signal as a function of the received parameters which are related to specific functionalities with variable gain. The volume control data included in the received data is supplied to a volume control unit 60 for supplying a corresponding input to a gain control unit 62 which receives also an input concerning the additional gain from the unit 58. Optional inputs from a user interface 61A, 61B are also acting on the gain control unit 62, in the form of local volume-up and volume-down buttons.

The gain control unit 62 acts on the feedback canceller unit 56 in order to adjust the gain applied to the received audio signal according to the volume settings of the user interface 42A, 42B of the transmission unit 16 and according and to the transmitter parameters processed in unit 58 and according to the volume settings of the user interface 61A, 61B of the receiver unit 52.

The feedback canceller unit 56 includes a time domain gain control unit 64, a frequency domain filter unit 66 and a time/frequency domain selection unit 68. The filter unit 66 includes an adaptive filter, such as a Wiener filter, working in the frequency domain and using a FFT (Fast Fourier Transform) and IFFT (Inverse Fast Fourier Transform) for transforming the audio signal from the time domain into the frequency domain and back into the time domain again. The filter unit 66 also outputs a feedback status signal to the time domain gain control unit 64 which is indicative of the presence or absence of feedback conditions. The time domain audio signal leaving the time domain gain control unit 64 is supplied both as input to the filter unit 66 and as a first input to the time/frequency domain selection unit 68. The time domain audio signal leaving the filter unit 66 is supplied as a second input to the time/frequency domain selection unit 68. The feedback status signal supplied to the time domain gain control unit 64 serves to reduce the system gain in case of critical feedback condition.

The gain control unit 62 supplies a gain status signal indicative of the system gain to the time/frequency domain selection unit 68, with the selection unit 68 selecting the time domain audio signal supplied from the time domain gain control unit 64, i.e., the time domain audio signal bypassing the filter unit 66, as the signal to be supplied to a frequency response equalizer unit 70 in case that the total acoustic gain is below a predefined critical value, and it selects the audio signal filtered by the filter unit 66 as the output to be supplied to the frequency response equalizer unit 70 in case that the total acoustic gain is above the predefined critical value. Thus, the feedback canceller unit 56 automatically switches between a first mode in which the audio signal bypasses the filter unit 66 and a second mode in which the audio signal is filtered by the filter unit 66, with the mode switching occurring automatically as a function of the total acoustic gain. The predefined critical value of the total acoustic gain used in the selection unit 68 can be fix for a typical room or it may optionally be a function of room parameters defined by the acoustical parameters of the room 10. Such room parameters may be supplied from a unit 69.

Alternatively, the switching could be controlled by a feedback detector using the feedback status signal provided by the filter unit 66, i.e., the mode switching would occur depending on whether the detected feedback is below or above a predefined critical value. However, reliable feedback detection is more difficult to implement than a gain-dependent switching, so that the selection unit 68 is preferably controlled by the gain status signal as shown in FIG. 4.

When the audio signal in the feedback canceller unit 56 bypasses the filter unit 66, artifacts caused by the signal processing and signal filtering in the filter unit 66 can be minimized and intelligibility can be maximized. In the case of relatively high gain, i.e., close to feedback, the filtering of the audio signal by the filter unit 66 serves to reduce feedback, thus allowing for a higher gain than without adaptive filter.

Room reverberation is mainly generated by the reflections of the lower audio frequencies which are less attenuated than the higher frequencies. In the far field (for example, a few meters from the loudspeaker) the level of the reverberation is essentially constant in a defined room with a defined test signal. High reverberation in a room degrades the intelligibility and causes feedback problems due to the pick-up of the reverberation by the microphones.

In order to minimize the room reverberation level with speech, the gain applied in a low frequency range below a frequency limit is lower than that applied in a high frequency range above the frequency limit. Preferably, the frequency limit is about 1 kHz. Such frequency response is implemented using the equalizer unit 70. By implementing such frequency response, good intelligibility can be obtained and the feedback behavior can be optimized in the sense that feedback will not occur at the lower frequencies, since the total acoustic gain in this lower frequency range is reduced, but rather will be pushed towards higher frequencies where a frequency shift is applied by the unit 38 in order to reduce feedback at higher frequencies.

The audio signal leaving the frequency response equalizer unit 70 is supplied to a power amplifier 22 for amplifying the audio signal at constant gain, with the amplified audio signal being supplied to the loudspeaker arrangement 24. The acoustical gain of the loudspeaker arrangement 24 supplied by the power amplifier 22 must be taken into account to define the predefined critical value of the total acoustic gain used in the selection unit 68.

While in the figures only one loudspeaker arrangement/array is shown, it is to be understood that the system may comprises more than one loudspeaker arrangement/array.

Rather than providing the frequency shift unit 38 in the transmission unit 16, it could be alternatively provided in the receiver unit 52 as a unit 38' (indicated in dashed lines in FIG. 4) in order to treat the received audio signal prior to being supplied to the feedback canceller unit 56.

Rather than providing the feedback canceller unit 56 in the receiver unit 52, it could be provided in the transmission unit 16.

The units 56 and 70 (and the unit 38' if present) form an audio signal processing unit 20 of the receiver unit 52.

In all embodiments, the transmission unit 16 may be compatible with hearing aids having a wireless audio interface, such as hearing aids having an FM (or DM) receiver unit connected via an audio shoe to the hearing aid or hearing aids having an integrated FM (or DM) receiver.

What is claimed is:

1. A system for speech enhancement in a room (10), comprising a directional lapel microphone arrangement for capturing an audio signal from a speaker's voice;

audio signal processing means (32, 34, 38, 38', 56, 70) for generating a processed audio signal from the captured audio signal, comprising an adaptive beamformer unit (32) for imparting a directivity to the microphone arrangement in a manner such that maximum sensitivity of the microphone arrangement is towards the speaker's mouth (21) and minimum sensitivity of the microphone arrangement is towards noise sources identified by the beamformer unit, a unit (38, 38') for shifting the frequency of components of the captured audio signal above a frequency threshold value only, a feedback cancelling unit (56) comprising an adaptive filter and a selection unit (68) adapted to automatically switch between a first mode in which the captured audio signal by-passes the adaptive filter when the total acoustic gain or the feedback is below a critical value and a second mode in which the captured audio signal is filtered by the adaptive filter when the total acoustic gain or the feedback is above said critical value;

a loudspeaker arrangement (24) to be located in a room for generating sound according to the processed audio signal and comprising a plurality of loudspeakers (25) arranged to form a directional loudspeaker array.

2. The system of claim 1, wherein the microphone arrangement (12) comprises at least two spaced apart, omnidirectional, microphones (12A, 12B).

3. The system of claim 1, wherein the beamformer unit (32) is adapted to process different frequency bands of the audio signals individually in order to allow for different directivity patterns in different frequency bands.

4. The system of claim 1, wherein the threshold value of the frequency shifting is from 500 Hz to 2kHz.

5. The system of claim 4, wherein the threshold value of the frequency shifting is about 850 Hz.

6. The system of claim 1, wherein frequencies of the components of the audio signal above the threshold value are shifted uniformly.

7. The system of claim 6, wherein the frequencies of the components of the captured audio signals above the threshold value are shifted upwards by about 5 Hz.

8. The system of one of claim 1, wherein the feedback cancelling unit (56) is adapted to transform the audio signal into the frequency domain for being filtered by the adaptive filter (66) and to retransform the filtered audio signal into the time domain.

9. The system of claim 1, wherein the directivity of the loudspeaker array (24) is such that the direction of the maximum sound amplitude is oriented substantially horizontal.

10. The system of claim 9, wherein the loudspeakers (25) are arranged stacked vertically one above another.

11. The system of claim 1, wherein the audio processing means (70) are adapted to apply a gain to the audio signal which is lower in a low frequency range below a frequency limit than in a high frequency range above said frequency limit.

12. The system of claim 11, wherein said frequency limit is from 300 Hz to 2 kHz.

13. The system of claim 1, wherein the microphone arrangement (12) is connected to a transmission unit (16) comprising the beamformer unit (32) and a transmitter (48) for transmitting the audio signal via a wireless link (19) to a receiver unit (52) comprising a receiver (18) for receiving the signal transmitted by the transmitter and being connected to the loudspeaker arrangement (24).

14. The system of claim 13, wherein the receiver unit (52) comprises the feedback cancelling unit (56).

15. The system of claim 13, wherein the transmission unit (16) comprises the frequency shifting unit (38).

16. The system of claim 13, wherein the receiver unit (52) comprises a gain control unit (62, 64) for controlling the gain applied to the received audio signal.

17. The system of claim 13, wherein the transmission unit (16) comprises means (36) for estimating parameters to enable variable gain functionalities by analyzing the captured audio signal, wherein the estimated parameters are to be transmitted via the wireless link (19) to the receiver unit (52) in order to be supplied as input to the gain control unit (62).

18. The system of claims 13, wherein the transmission unit (16) is compatible with hearing aids having a wireless audio interface.

19. The system of claim 1, wherein the system comprises a power amplifier (22) for amplifying, at constant gain, the processed audio signal in order to produce an amplified processed audio signal to be supplied to loudspeaker arrangement (24).

20. The system of claim 1, wherein said critical value is a predefined fixed value.

21. The system of claim 1, wherein said critical value is individually determined according to acoustic parameters of the specific room in which the system is to be used.

22. A method of speech enhancement in a room (10), comprising the steps of:

capturing an audio signal from a speaker's voice by a directional lapel microphone arrangement (12), processing the captured audio signal to produce a processed audio signal, said processing comprising, identifiying noise sources and imparting a directivity to the microphone arrangement by applying an adaptive beamforming to the captured audio signal in such a manner that the maximum sensitivity of the microphone arrangement is towards the speaker's mouth (21) and the minimum sensitivity is towards said identified noise sources, shifting the frequency of components of the captured audio signal above a threshold value only, applying feedback cancelling to the captured audio signal comprising a first mode in which the audio signal bypasses a Wiener filter and a second mode in which the audio signal is filtered by the Wiener filter, wherein it is automatically switched into the first mode when the total acoustic gain or the feedback is below a critical value and into the second mode if the total acoustic gain or the feedback is above said critical value; and generating sound according to the processed audio signal by a loudspeaker arrangement (24) located in the room, said loudspeaker arrangement comprising a plurality of loudspeakers (25) arranged to form a directional loudspeaker array.

* * * * *